US009325120B2

(12) United States Patent
Imahori

(10) Patent No.: US 9,325,120 B2
(45) **Date of Patent: *Apr. 26, 2016**

(54) WIRE HARNESS AND CONNECTION STRUCTURE OF SHIELD SHELL AND BRAIDED SHIELD

(71) Applicant: Hitachi Metals, Ltd., Tokyo (JP)

(72) Inventor: Masaaki Imahori, Hitachinaka (JP)

(73) Assignee: Hitachi Metals, Ltd., Tokyo (JP)

( * ) Notice: Subject to any disclaimer, the term of this patent is extended or adjusted under 35 U.S.C. 154(b) by 49 days.

This patent is subject to a terminal disclaimer.

(21) Appl. No.: 14/137,470

(22) Filed: Dec. 20, 2013

(65) Prior Publication Data

US 2014/0179161 A1 Jun. 26, 2014

(30) Foreign Application Priority Data

Dec. 25, 2012 (JP) ..... 2012-280679

(51) Int. Cl.
*H01R 9/03* (2006.01)
*H01R 13/6592* (2011.01)
(Continued)

(52) U.S. Cl.
CPC ..... *H01R 13/6592* (2013.01); *H01R 13/506* (2013.01); *H01R 13/5205* (2013.01); *H01R 2201/26* (2013.01)

(58) Field of Classification Search
CPC ..... B60R 16/0215; H02G 15/068; H02G 15/013; H05K 9/0015; H05K 9/0001; H05K 9/0521; H05K 9/032; H01L 23/552; H01R 13/658; H01R 13/748; H01R 13/5208; H01R 13/5205; H01R 13/506; H01R 13/65802; H01R 13/514; H01R 13/5202; H01R 13/5219; H01R 13/6581
USPC ..... 439/564, 578, 583, 587, 589, 98, 904, 439/905, 607.01, 607.15, 607.23, 607.27, 439/607.28, 607.41, 607.44, 607.45, 607.5, 439/607.52, 607.55, 607.57, 607.58; 174/72 A, 74 R, 75 C, 350, 357, 359, 174/373, 377
See application file for complete search history.

(56) References Cited

U.S. PATENT DOCUMENTS 6,864,426 B2 * 3/2005 Miyazaki ..... 174/75 C
6,921,292 B2 * 7/2005 Miyazaki ..... 439/564
(Continued)

FOREIGN PATENT DOCUMENTS

JP 04-035626 U 3/1992
JP 10-050392 A 2/1998
JP 2004171952 A 6/2004

OTHER PUBLICATIONS

Japanese Office Action for application No. 2012-280679 dated Nov. 17, 2015 and English translation.

*Primary Examiner* — Amy Cohen Johnson
*Assistant Examiner* — Milagros Jeancharles
(74) *Attorney, Agent, or Firm* — Roberts Mlotkowski Safran & Cole, PC

(57) ABSTRACT

A wire harness includes an electric wire, a conductive metal shield shell housing a portion of the electric wire, a braided shield covering at least a portion of an outer peripheral surface of the shield shell and extending from an end portion of the shield shell in a lead-out direction of the electric wire to cover the electric wire, and an annular member provided on the outer periphery of the braided shield so as to sandwich the braided shield between itself and the shield shell. The annular member includes an extended portion that extends from the end portion of the shield shell along the lead-out direction of the electric wire.

4 Claims, 6 Drawing Sheets

(51) Int. Cl.
*H01R 13/506* (2006.01)
*H01R 13/52* (2006.01)

(56) References Cited

U.S. PATENT DOCUMENTS 7,041,907 B2 * 5/2006 Miyazaki ..... 174/72 A
7,094,970 B2 8/2006 Kihira
8,895,875 B2 * 11/2014 Kato et al. ..... 174/359
8,956,189 B2 * 2/2015 Imahori et al. ..... 439/607.55
2002/0157843 A1 10/2002 Fukushima et al.
2004/0099427 A1 5/2004 Kihira
2012/0270444 A1 10/2012 Kawamura
2014/0038459 A1 * 2/2014 Kobayashi ..... 439/607.41

* cited by examiner

31 FIRST MEMBER 32 SECOND MEMBER 41 ACCOMMODATING PORTION
521 CONNECTING PORTION 522 EXTENDED PORTION

WIRE HARNESS AND CONNECTION STRUCTURE OF SHIELD SHELL AND BRAIDED SHIELD

The present application is based on Japanese patent application No. 2012-280679 filed on Dec. 25, 2012, the entire contents of which are incorporated herein by reference.

BACKGROUND OF THE INVENTION

1. Field of the Invention

The invention relates to a wire harness provided with an electric wire(s) and a braided shield covering the outer periphery thereof, as well as a connection structure of a shield shell and a braided shield.

2. Description of the Related Art

A wire harness is known that has plural electric wires for connecting e.g. a motor as a drive source to an inverter in a vehicle and that is provided with a braided shield so as to reduce an electromagnetic noise emitted from the electric wires to the outside (See e.g. JP-A-2004-171952).

The wire harness disclosed in JP-A-2004-171952 has a conductive shield shell fixed to a shield case of an inverter by a bolt, and a cylindrical braided shield covering the plural electric wires. The shield shell has a cylindrical portion for inserting the plural electric wires and a plate-shaped attaching portion projecting outward from a front edge of the cylindrical portion on the inverter side, and a bolt-hole for insertion of a fixing bolt is formed on the attaching portion. The braided shield is fixed to the outer peripheral surface of the cylindrical portion of the shield shell by an annular crimp ring. The crimp ring is fitted onto the braided shield in a region corresponding to the outer periphery of the cylindrical portion of the shield shell.

SUMMARY OF THE INVENTION

When the wire harness configured as such is used in e.g. a vehicle, water from the road surface may be splashed on a connecting portion between the shield shell and the braided shield when running a vehicle. The water splashed on the connecting portion between the shield shell and the braided shield penetrates and remains on the outer periphery of the cylindrical portion of the shield shell, and may corrode the surface of the shield shell especially in case that salt used for a road deicer etc. is contained in the water.

It is an object of the invention to provide a wire harness that can prevent the penetration of water etc. through the interval between a shield shell of conductive metal and a braided shield, as well as a connection structure of the shield shell and the braided shield.

(1) According to one embodiment of the invention, a wire harness comprises:

an electric wire;

a conductive metal shield shell housing a portion of the electric wire;

a braided shield covering at least a portion of an outer peripheral surface of the shield shell and extending from an end portion of the shield shell in a lead-out direction of the electric wire to cover the electric wire; and an annular member provided on the outer periphery of the braided shield so as to sandwich the braided shield between the annular member and the shield shell, wherein the annular member comprises an extended portion that extends from the end portion of the shield shell along the lead-out direction of the electric wire.

In the above embodiment (1) of the invention, the following modifications and changes can be made.

(i) The extended portion has such a tapered shape that a space between inner surfaces facing each other with the electric wire in between is narrowed toward the front end along an extending direction of the braided shield.

(ii) The extended portion is formed by winding a tape around the outer periphery of the braided shield, and wherein the tape comprises an adhesive layer formed on a surface facing the braided shield.

(2) According to another embodiment of the invention, a connection structure comprises a shield shell and a braided shield, wherein the shield shell comprises a conductive metal and houses a portion of an electric wire, wherein the braided shield extends from an end portion of the shield shell in a lead-out direction of the electric wire to cover the electric wire, wherein the connection structure further comprises an annular member provided on the outer periphery of the braided shield so as to sandwich the braided shield between the annular member and the shield shell, and wherein the annular member comprises an extended portion that extends from the end portion of the shield shell along the lead-out direction of the electric wire.

Effects of the Invention

According to one embodiment of the invention, a wire harness can be provided that can prevent the penetration of water etc. through the interval between a shield shell of conductive metal and a braided shield, as well as a connection structure of the shield shell and the braided shield.

BRIEF DESCRIPTION OF THE DRAWING

Next, the present invention will be explained in more detail in conjunction with appended drawings, wherein:

FIGS. 3A and 3B show cross sections of the wire harness, wherein FIG. 3A is a cross sectional view taken on line A-A of FIG. 1 and FIG. 3B is a cross sectional view taken along an extending direction of an electric wire(s);

FIGS. 5A and 5B show a portion of the wire harness, wherein FIG. 5A is a perspective view before attaching a second annular member and FIG. 5B is a perspective view after attaching the second annular member.

DETAILED DESCRIPTION OF THE PREFERRED EMBODIMENT

Embodiment

Figure 1:
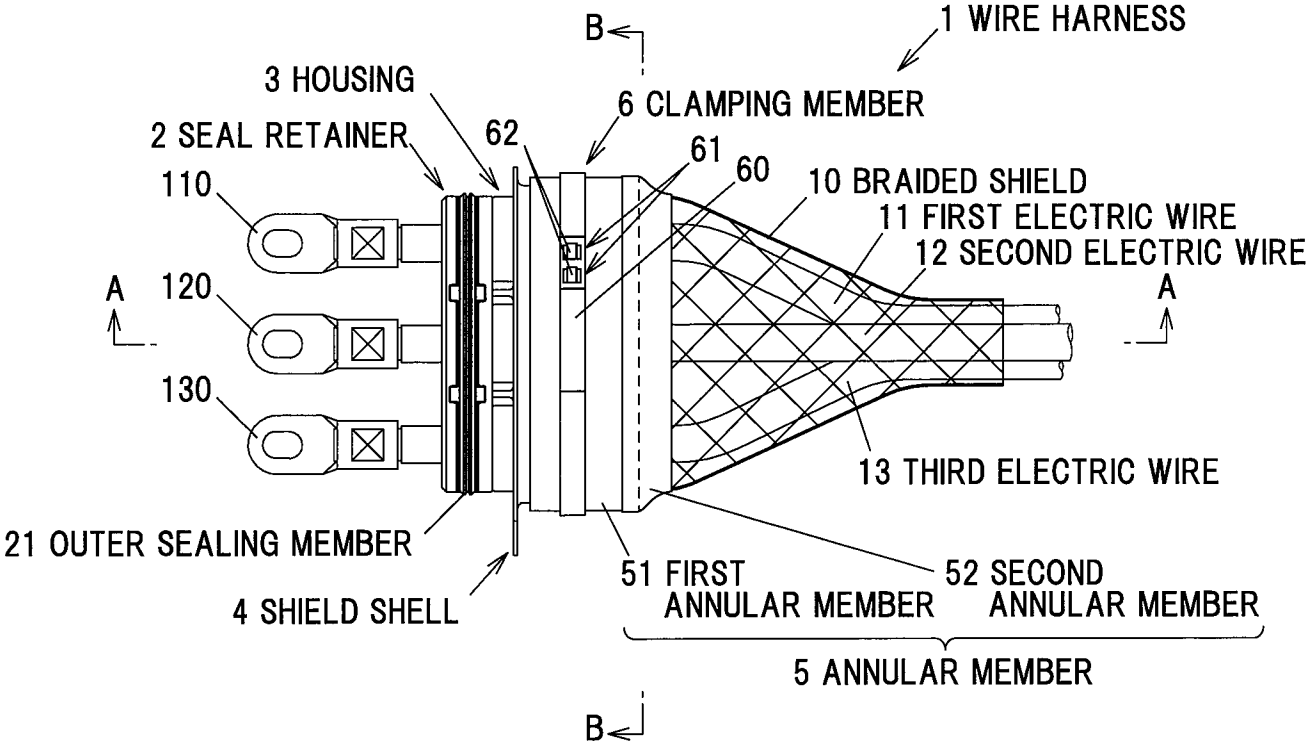
FIG. 1 is a structural view showing an example of a wire harness in an embodiment of the present invention.
Figure 2:
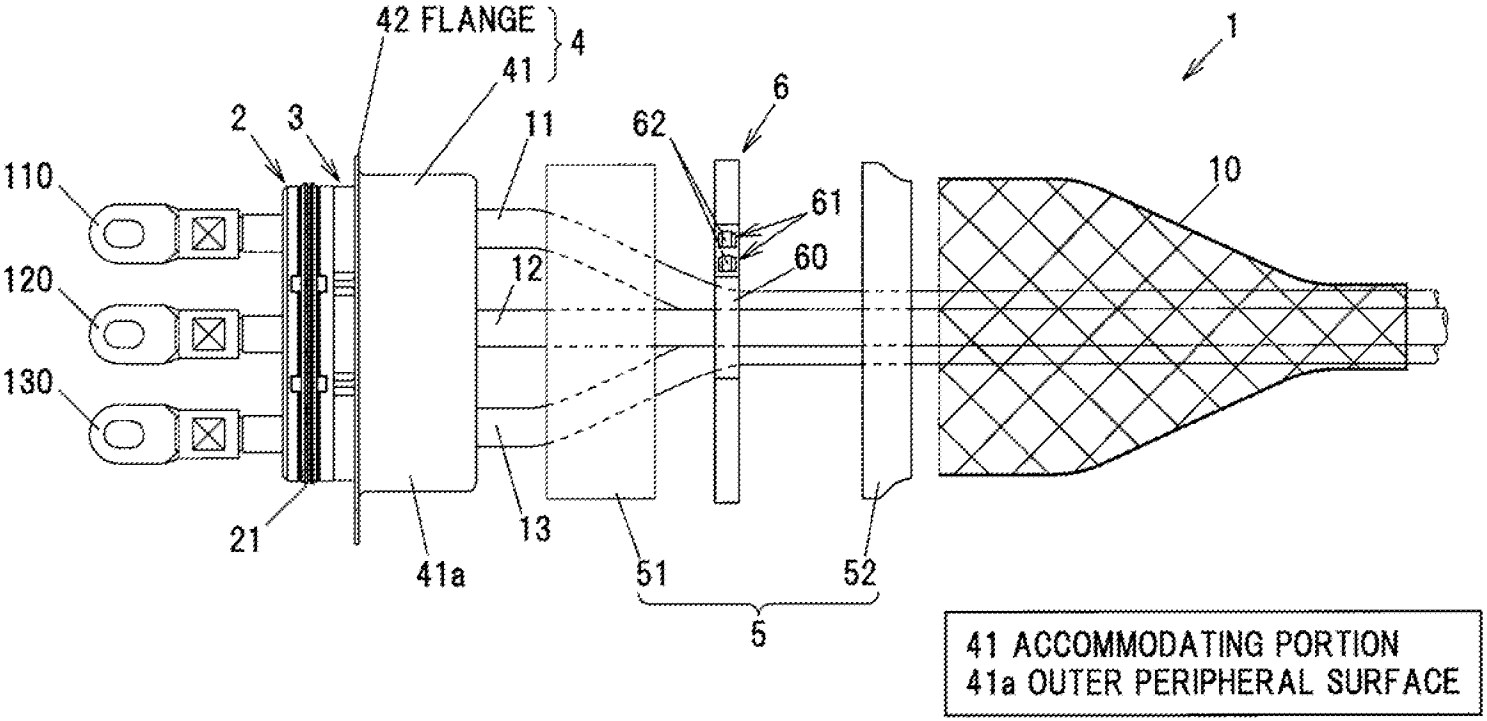
FIG. 2 is an exploded view of the wire harness shown in FIG. 1.
Figure 3A:
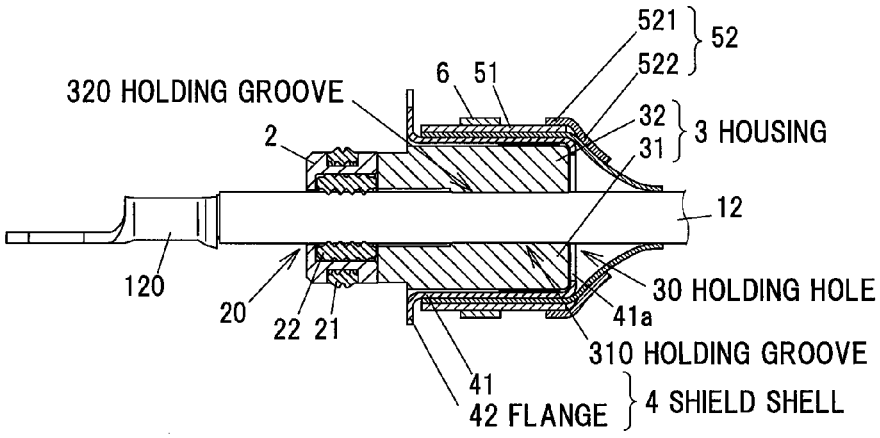
Figure 3B:
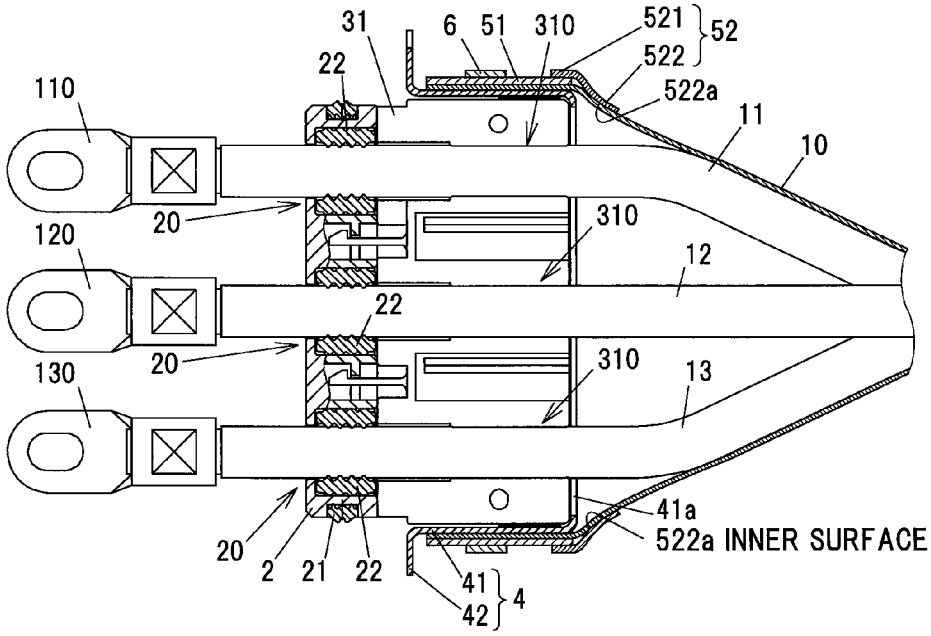

FIG. 1 is a structural view showing an example of a wire harness in the embodiment of the invention. FIG. 2 is an exploded view of the wire harness shown in FIG. 1, FIG. 3A is a cross sectional view taken on line A-A of FIG. 1 and FIG. 3B is a cross sectional view showing a portion of the wire harness taken along three electric wires.

Structure of Wire Harness 1

A wire harness 1 is provided with first to third electric wires 11 to 13, a seal retainer 2 for holding an outer sealing member 21 on an outer periphery thereof, a housing 3 for partially housing and holding the first to third electric wires 11 to 13, a shield shell 4 formed of a conductive metal, an annular member 5 provided on an outer periphery of a braided shield 10 such that the braided shield 10 is sandwiched between the shield shell 4 and the annular member 5, and a clamping member 6 arranged on the outer periphery of the annular member 5. The wire harness 1 is used for connecting, e.g., an inverter to a motor as a drive source for running a vehicle.

The first to third electric wires 11 to 13 are wires for supplying, e.g., three-phase AC to a motor and have connecting terminals 110, 120 and 130 crimped to respective end portions.

The seal retainer 2 has plural insertion holes 20 (three in the present embodiment) for respectively inserting the first to third electric wires 11 to 13, as shown in FIG. 3B. An annular inner sealing member 22 for sealing between an outer peripheral surface of the first, second or third wire 11, 12 or 13 and an inner peripheral surface of the insertion hole 20 is held on an inner peripheral surface of each insertion hole 20. Meanwhile, an annular outer sealing member 21 for sealing between an outer peripheral surface of the seal retainer 2 and an inner surface of a mounting hole formed on a non-illustrated attachment target device (a motor or an inverter, etc.) is held on the outer peripheral surface of the seal retainer 2.

As shown in FIG. 3A, the housing 3 is formed by coupling a first member 31 and a second member 32 which are formed of resin. Semicircular holding grooves 310 are formed on the first member 31 so as to correspond to the first to third electric wires 11 to 13 and semicircular holding grooves 320 are formed on the second member 32 so as to correspond to the first to third electric wires 11 to 13. The holding grooves 310 are combined with the holding grooves 320 by coupling the first member 31 to the second member 32, thereby forming holding holes 30 for respectively holding the first to third electric wires 11 to 13.

As shown in FIG. 2, the shield shell 4 integrally has a cylindrical accommodating portion 41 for accommodating a portion of the housing 3 and a flange 42 used for attaching the shield shell 4 to the non-illustrated attachment target device. Through-holes 420 (see FIG. 4A) for inserting bolts used for fixing to the non-illustrated attachment target device are formed on the flange 42. In the present embodiment, the shield shell 4 is formed of a tin-plated steel sheet.

In the present embodiment, the annular member 5 is composed of a first annular member 51 and a second annular member 52. The first annular member 51 is provided on an outer peripheral surface 41*a* of the accommodating portion 41 of the shield shell 4 and the belt-shaped clamping member 6 is provided on the outer periphery of the first annular member 51. In addition, the first annular member 51 is formed so that a width thereof in the extending direction of the first to third electric wires 11 to 13 is wider than the clamping member 6. A widthwise end portion of the second annular member 52 covers the outer periphery of the first annular member 51.

As shown in FIGS. 3A and 3B, the second annular member 52 has a connecting portion 521 connected to a widthwise end portion of the first annular member 51 and an extended portion 522 extending from an end portion of the shield shell 4 (an end portion opposite to the flange 42) along a lead-out direction of the first to third electric wires 11 to 13. In more detail, the connecting portion 521 is connected to the outer peripheral surface of the first annular member 51 at an end portion in a width direction (a direction parallel to the extending direction of the first to third electric wires 11 to 13) opposite to the flange 42.

The extended portion 522 is integrally and continuously formed from an end portion of the connecting portion 521 and extents in the lead-out direction of the first to third electric wires 11 to 13 from the end portion of the connecting portion 521 opposite to the flange 42 (toward the side opposite to the connecting terminals 110, 120 and 130). Meanwhile, the extended portion 522 has a tapered shape in which a space between inner surfaces 522*a* facing each other with the first to third electric wires 11 to 13 in between (a distance between the inner surfaces 522*a* in a direction orthogonal to the extending direction of the first to third electric wires 11 to 13) is narrowed toward the front end portion (an end portion opposite to the connecting portion 521). In other words, the inner diameter of the extended portion 522 is large on the connecting portion 521 side and is narrowed toward the end portion opposite to the connecting portion 521 along the braided shield 10 and the first to third electric wires 11 to 13.

The clamping member 6 is formed of a belt-shaped metal such as stainless steel or iron and is arranged so as to sandwich the braided shield 10 and the first annular member 51 between itself and the outer peripheral surface 41*a* of the accommodating portion 41 of the shield shell 4. At one longitudinal end portion of the clamping member 6, plural openings 61 (two in the present embodiment) are formed. And at another end portion, plural protrusions 62 (two in the present embodiment) engaged with the openings 61 are formed. The clamping member 6 is wound around the first annular member 51 so that the end portion having the openings 61 covers an outer periphery of the other end portion having the protrusions 62, and the clamping member 6 is crimped by a tool in a state that the protrusions 62 are engaged so as to protrude from the openings 61, thereby generating a tightening force of the clamping member 6. A clamped portion 60 (see FIG. 4A) is formed by the crimping. In addition, the clamping member 6 presses the braided shield 10 against the outer peripheral surface 41*a* of the accommodating portion 41 of the shield shell 4 via the first annular member 51 by the tightening force thereof.

Figure 4A:
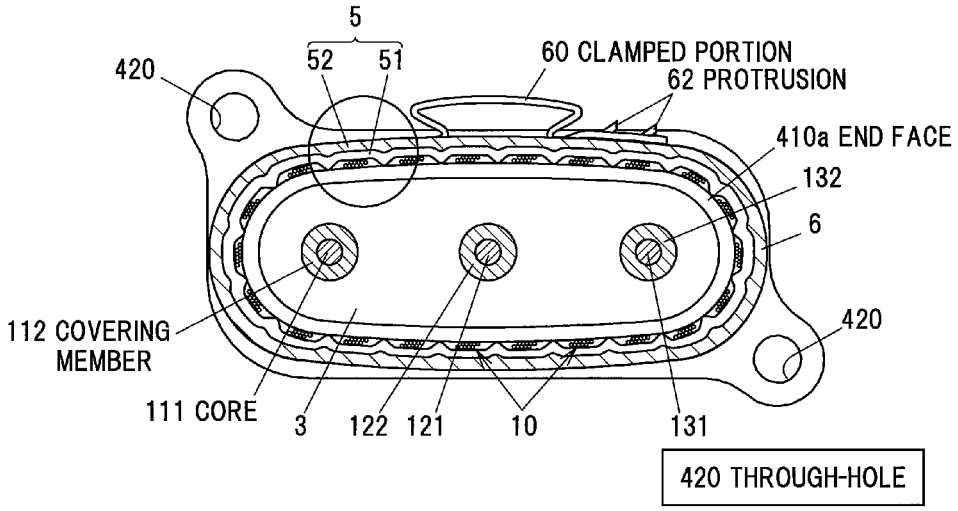
FIG. 4A is a cross sectional view taken on line B-B of FIG. 1
Figure 4B:
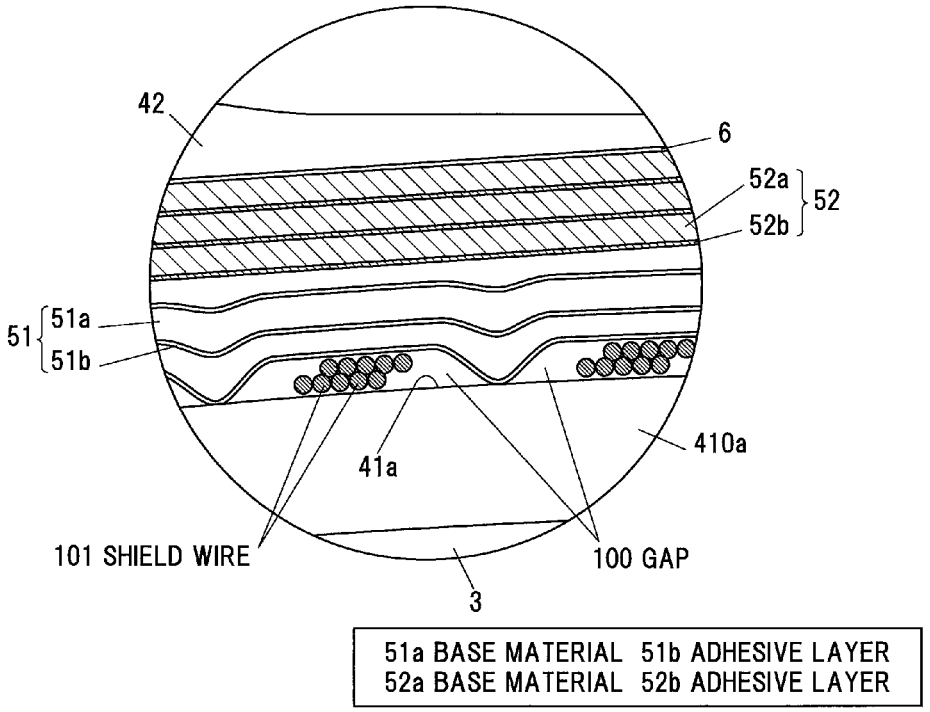
FIG. 4B is a partial enlarged view of FIG. 4A.

FIG. 4A is a cross sectional view taken on line B-B of FIG. 1 and FIG. 4B is a partial enlarged view of FIG. 4A.

Structure of Annular Member 5

The first annular member 51 has higher elasticity than the clamping member 6 and is deformed by the tightening force of the clamping member 6. In addition, an inner peripheral surface of the first annular member 51 is in contact with surfaces of plural shield wires 101 constituting the braided shield 10 and an outer peripheral surface of the first annular member 51 is in contact with the clamping member 6. In the present embodiment, the first annular member 51 is formed of a tape having a belt-shaped base material 51*a* and an adhesive layer 51*b* which is formed on the inner peripheral surface of the base material 51*a* and has adhesive properties. The tape is, e.g., an acetate cloth tape with the base material 51*a* formed of acetate fibers and is wound several times so as to surround the braided shield 10. The thickness of the tape is, e.g., 0.2 mm. FIG. 4B shows the case where the tape is wound 3 times.

The adhesive layer 51*b* of the first annular member 51 makes the plural shield wires 101 stick to the first annular member 51. In addition, the adhesive layer 51*b* is in contact with the outer peripheral surface 41*a* of the accommodating portion 41 of the shield shell 4 between the plural shield wires 101 and other plural shield wires 101, and the first annular member 51 thus sticks to the shield shell 4.

The second annular member 52 is formed of a tape having a belt-shaped base material 52*a* and an adhesive layer 52*b* which is formed on the inner peripheral surface of the base material 52*a* and has adhesive properties. The second annular member 52 is, e.g., a vinyl tape with the base material 52*a* formed of vinyl chloride. In addition, the second annular member 52 is arranged so as to cover the outer periphery side of an end face 410*a*, in the lead-out direction of the first to third electric wires 11 to 13, of the accommodating portion 41 of the shield shell 4, and is configured such that a portion on the first annular member 51 side serves as the connecting portion 521 and a portion on the front end side beyond the end face 410*a* of the accommodating portion 41 serves as the extended portion 522. FIG. 4B shows the case where the tape is wound 3 times.

The first to third electric wires 11 to 13 are respectively composed of cores 111, 121 and 131 each formed of a conductor and covering members 112, 122 and 132 formed of an insulating resin and covering the cores 111, 121 and 131 each formed of a conductor.

Figure 5A:
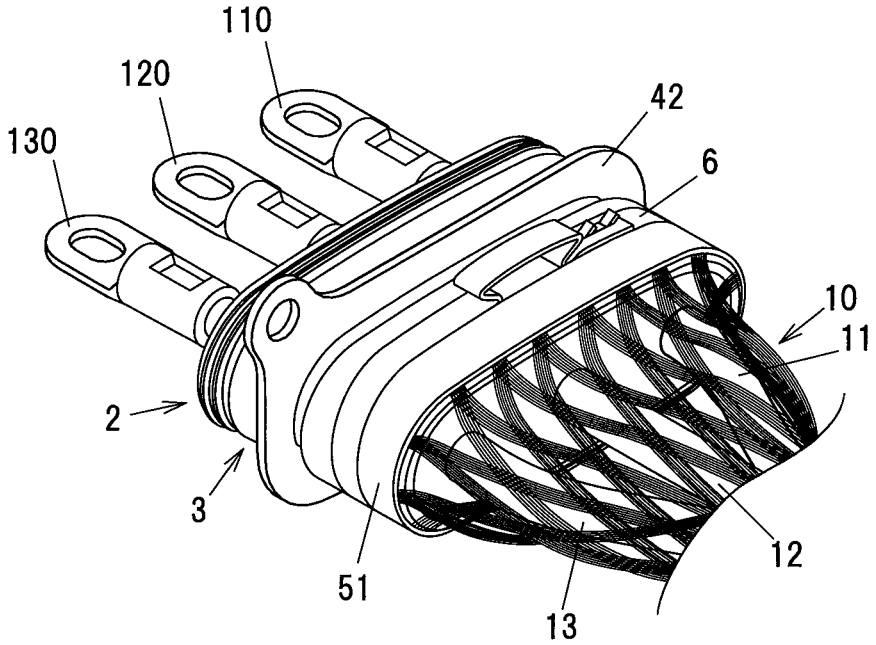
Figure 5B:
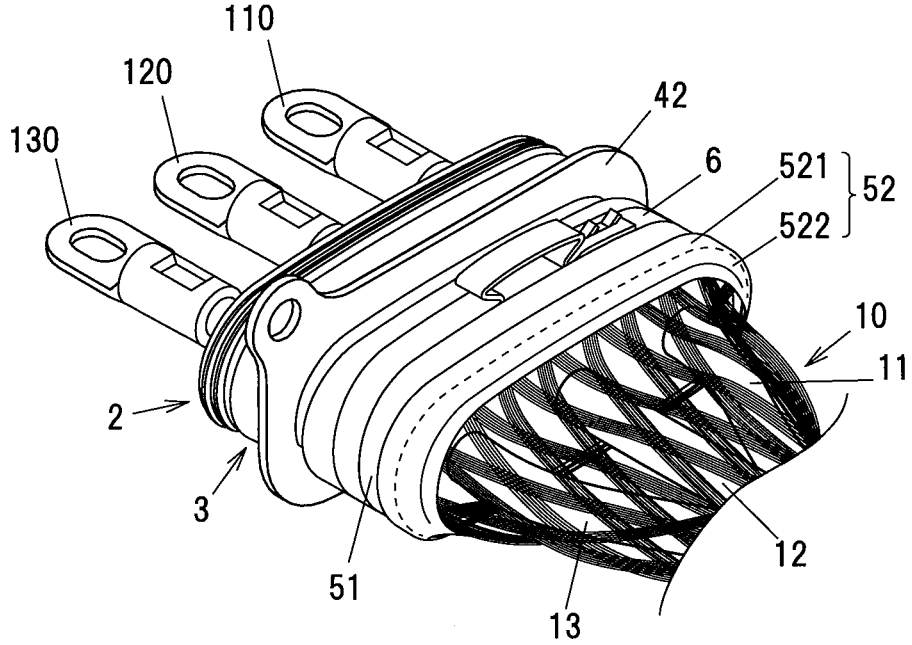

FIGS. 5A and 5B show a portion of the wire harness 1, wherein FIG. 5A is a perspective view before attaching the second annular member 52 and FIG. 5B is a perspective view after attaching the second annular member 52.

Connection Structure of Braided Shield 10 and Shield Shell 4

The braided shield 10 covers at least a portion of the outer peripheral surface 41*a* of the accommodating portion 41 of the shield shell 4 and extends from an end portion of the shield shell 4 in the lead-out direction of the first to third electric wires 11 to 13 to cover the first to third electric wires 11 to 13 all together. In addition, as shown in FIGS. 5A and 5B, the braided shield 10 is formed by braiding, e.g., conductive wires formed of metal such as copper alloy and, at an end portion to be connected to the accommodating portion 41 of the shield shell 4, the inner diameter of the braided shield 10 is enlarged by stretching mesh of the braid in a circumferential direction.

A procedure of connecting the braided shield 10 to the shield shell 4 and a procedure of assembling the annular member 5 with the clamping member 6 will be describe below. It should be noted that the assembly procedure is only shown as an example and it is possible to carry out assembly without following this procedure.

The braided shield 10 is arranged so that the end portion to be connected to the accommodating portion 41 of the shield shell 4 covers the outer peripheral surface 41*a* of the accommodating portion 41. Next, the first annular member 51 is wound several times around the outer periphery of the braided shield 10. Thus, the first annular member 51, the braided shield 10 and the accommodating portion 41 are adhered to each other by the adhesive layer 51*b* (see FIGS. 4A and 4B).

Next, the clamping member 6 is attached to the outer periphery of the first annular member 51. Tightening of the clamping member 6 causes the first annular member 51 to shrink in a diameter-reducing manner. In addition, the braided shield 10 is pressed against the accommodating portion 41 of the shield shell 4 by the tightening force of the clamping member 6. Accordingly, the braided shield 10 comes into contact with the outer peripheral surface 41*a* of the shield shell 4 and is electrically connected to the shield shell 4.

Next, a tape to be the second annular member 52 is wound around so that the adhesive layer 52*b* comes into contact with the outer periphery of the first annular member 51. The second annular member 52 is attached such that the connecting portion 521 is wound around the outer peripheral surface of the end portion of the first annular member 51 on the opposite side to the flange 42 of the shield shell 4 and the extended portion 522 is wound around the outer periphery of the braided shield 10. For shaping the second annular member 52 into a tapered shape, for example, a tape is wound into a cylindrical shape and the inner surface 522*a* thereof is then pressed against the braided shield 10 by pinching the extended portion 522 at both end portions in a parallel direction of the first to third electric wires 11 to 13.

Functions and Effects of the Embodiment

The following functions and effects are obtained in the embodiment.

(1) Since the second annular member 52 is arranged between the shield shell 4 and the braided shield 10 in the extending direction of the first to third electric wires 11 to 13 and covers the outer side of the braided shield 10 from the end portion of the first annular member 51 on the opposite side to the flange 42 of the shield shell 4 toward the extending direction of the braided shield 10, entry of salty water, etc., into plural gaps 100 (see FIGS. 4A and 4B) formed between the outer peripheral surface 41*a* of the shield shell 4 and the braided shield 10 is suppressed. In other words, e.g., water, etc., splashed when running a vehicle only hits the extended portion 522 of the second annular member 52, and entry of water, etc., into the gaps 100 is thus suppressed. As a result, it is possible to suppress corrosion of the shield shell 4.

(2) Since the extended portion 522 of the second annular member 52 has a tapered shape in which the inner surfaces 522*a* facing each other with the first to third electric wires 11 to 13 in between come closer to each other toward the front end portion along the extending direction of the braided shield 10, an opening area at the front end portion is small. This allows the entry of water, etc., into the gaps 100 to be suppressed more reliably.

(3) Since the second annular member 52 is formed of a tape wound around several times so as to surround the braided shield 10, it is not necessary to separately provide a member for attaching the annular member 52 and assembly is thus easy.

Modification

Figure 6:
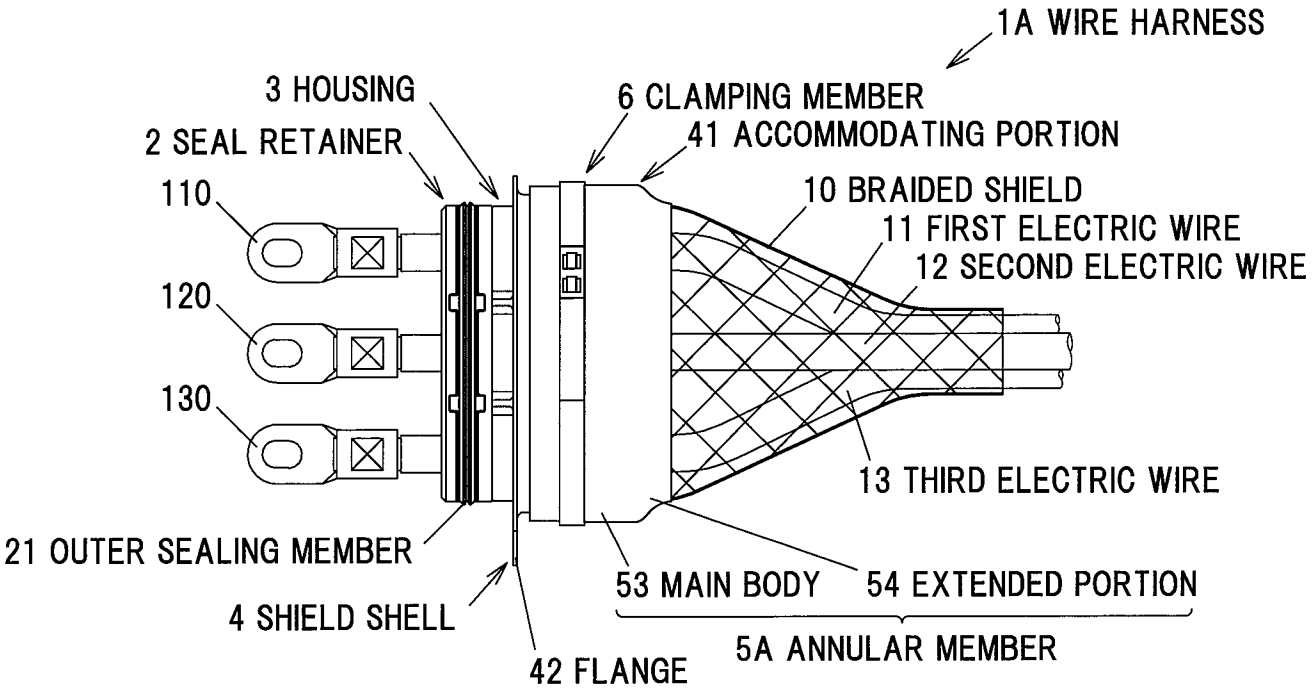
FIG. 6 is a structural view showing a wire harness in a modification of the embodiment.

FIG. 6 is a structural view showing a wire harness 1A in a modification of the embodiment.

In the present modification, constituent elements having the same functions as those described in the embodiment are denoted by the same or corresponding reference numerals and names, and the explanation thereof will be omitted.

In the wire harness 1A in the present modification, the structure of an annular member 5A is different from that of the annular member 5 in the embodiment but other configuration and functions are the same as those of the embodiment. In more detail, the annular member 5A in the present modification is formed of a single member having a main body 53 and an extended portion 54 while the annular member 5 in the embodiment is composed of two members, the first annular member 51 and the second annular member 52.

The main body 53 of the annular member 5A corresponds to the first annular member 51 of the embodiment. In other words, the main body 53 is provided on the outer peripheral surface 41*a* of the accommodating portion 41 of the shield shell 4 and the outer periphery of the main body 53 is tightened by the clamping member 6.

The extended portion 54 of the annular member 5A corresponds to the extended portion 522 of the second annular member 52 of the embodiment. In other words, the extended portion 54 extends from the end portion of the accommodating portion 41 opposite to the flange 42 along the lead-out direction of the first to third electric wires 11 to 13 (the extending direction of the braided shield 10).

The annular member 5A is formed of a tape which is wound several times around the outer periphery of the braided shield 10 from the end portion of the accommodating portion 41 of the shield shell 4 opposite to the flange 42 toward the lead-out direction of the first to third electric wires 11 to 13.

The present modification achieves the same functions and effects as the functions and effects (1) to (3) described in the embodiment. Furthermore, since the annular member 5A is formed of a single member, it is possible to reduce the number of required members, leading to the cost reduction.

SUMMARY OF THE EMBODIMENT

Technical ideas understood from the embodiment will be described below citing the reference numerals, etc., used for the embodiment. However, each reference numeral, etc., described below is not intended to limit the constituent elements in the claims to the members specifically described in the embodiment.

[1] A wire harness (1, 1A), comprising: electric wires (first to third electric wires 11 to 13); a conductive metal shield shell (4) housing a portion of the first to third electric wires (11 to 13); a braided shield (10) covering at least a portion of an outer peripheral surface (41*a*) of the shield shell 4 and extending from an end portion of the shield shell (4) in a lead-out direction of the first to third electric wires (11 to 13) to cover the first to third electric wires (11 to 13); and an annular member (5, 5A) provided on the outer periphery of the braided shield (10) so as to sandwich the braided shield (10) between itself and the shield shell (4), wherein the annular member (5, 5A) has an extended portion (522, 54) that extends from the end portion of the shield shell (4) along the lead-out direction of the first to third electric wires (11 to 13).

[2] The wire harness (1, 1A) described in the [1], wherein the extended portion (522, 54) has a tapered shape such that a space between inner surfaces (522*a*) facing each other with the first to third electric wires (11 to 13) in between is narrowed toward the front end along an extending direction of the braided shield (10).

[3] The wire harness (1, 1A) described in the [1] or [2], wherein the extended portion (522, 54) is formed by winding a tape around the outer periphery of the braided shield (10), the tape having an adhesive layer (52*b*) formed on a surface facing the braided shield (10).

[4] A connection structure of a shield shell (4) and a braided shield (10), the shield shell (4) being formed of conductive metal and housing a portion of electric wires (first to third electric wires 11 to 13) and the braided shield (10) extending from an end portion of the shield shell (4) in a lead-out direction of the first to third electric wires (11 to 13) to cover the first to third electric wires (11 to 13), the structure comprising: an annular member (5, 5A) provided on the outer periphery of the braided shield (10) so as to sandwich the braided shield (10) between itself and the shield shell (4), wherein the annular member (5, 5A) has an extended portion (522, 54) that extends from the end portion of the shield shell (4) along the lead-out direction of the first to third electric wires (11 to 13).

Although the embodiment of the invention has been described, the invention according to claims is not to be limited to the above-mentioned embodiment. Further, please note that all combinations of the features described in the embodiment are not necessary to solve the problem of the invention.

Although the annular member 5 or 5A formed by winding a tape has been described in the embodiment, it is not limited thereto. For example, heat-shrinkable tubes or sheets may be used.

In addition, although the first annular member 51 formed by winding a tape has been described in the embodiment, it is not limited thereto, and the first annular member 51 may be formed of, e.g., rubber or resin.

In addition, although the clamping member 6 is tightened by crimping in the embodiment, it is not limited thereto. The clamping member 6 may be tightened by a bolt and a nut.

In addition, the number of the electric wires is not limited to three and is not specifically limited.

What is claimed is:

1. A wire harness, comprising:

an electric wire;

a conductive metal shield shell housing a portion of the electric wire;

a braided shield covering at least a portion of an outer peripheral surface of the shield shell and extending from an end portion of the shield shell in a lead-out direction of the electric wire to cover the electric wire; and an annular member provided on the outer periphery of the braided shield so as to sandwich the braided shield between the annular member and the shield shell, wherein a clamping member has a belt-shape and is arranged so as to sandwich the braided shield and the annular member between the clamping member and the outer peripheral surface of the shield shell, the clamping member is configured to press the braided shield against the shield shell by a tightening force of the clamping member, wherein the clamping member presses the braided shield against the shield shell via the annular member, wherein the annular member comprises an extended portion that extends from the end portion of the shield shell along the lead-out direction of the electric wire, and wherein the annular member further comprises a first annular member contacting the clamping member and the braided shield; and a second annular member comprising the extended portion.

2. The wire harness of claim 1, wherein the second annular member comprises a connecting portion contacting and covering an outer periphery of the first annular member.

3. The wire harness of claim 2, wherein the extended portion is integrally and continuously formed from an end portion of the connecting portion.

4. The wire harness of claim 3, wherein the extended portion contacts the braided shield.

* * * * *